US006513174B1

(12) United States Patent
Johansson

(10) Patent No.: US 6,513,174 B1
(45) Date of Patent: Feb. 4, 2003

(54) VACUUM UNIT AND A VACUUM TOILET SYSTEM COMPRISING SUCH A UNIT

(75) Inventor: Håkan Johansson, Stockholm (SE)

(73) Assignee: AVAC Vakuumteknik AB, Mullsjo (SE)

( * ) Notice: Subject to any disclaimer, the term of this patent is extended or adjusted under 35 U.S.C. 154(b) by 0 days.

(21) Appl. No.: 09/959,784

(22) PCT Filed: May 5, 2000

(86) PCT No.: PCT/SE00/00900

§ 371 (c)(1),
(2), (4) Date: Jan. 16, 2002

(87) PCT Pub. No.: WO00/70156

PCT Pub. Date: Nov. 23, 2000

(30) Foreign Application Priority Data

May 17, 1999 (SE) ..... 9901776

(51) Int. Cl.[7] ..... E03D 11/00

(52) U.S. Cl. ..... 4/431; 4/321

(58) Field of Search ..... 4/321, 323, 431, 4/434; 417/160

(56) References Cited

U.S. PATENT DOCUMENTS 5,754,987 A * 5/1998 Johansson et al. ..... 4/431

* cited by examiner

*Primary Examiner*—Robert M. Fetsuga
(74) *Attorney, Agent, or Firm*—Sughrue Mion, PLLC

(57) ABSTRACT

A vacuum unit, particularly for a vacuum toilet system, includes first and second valves (4, 6), an ejector (10) connected to the first valve, and a piston valve (16) which is connected between the ejector and the second valve. The unit is characterised in that an overpressure and a vacuum can both be generated from the first valve (4) by controlling the state of the piston valve by the combination of the states of the first and the second valves. A vacuum toilet system is also described.

9 Claims, 2 Drawing Sheets

VACUUM UNIT AND A VACUUM TOILET SYSTEM COMPRISING SUCH A UNIT

TECHNICAL FIELD

The present invention relates to a unit for generating, maintaining and eliminating a vacuum and for generating, maintaining and eliminating pressure in, e.g., a tank for collecting and further transporting waste in a vacuum toilet. The invention also relates to a system that includes a vacuum unit constructed in accordance with the invention.

BACKGROUND

Vacuum ejectors that work in accordance with the so-called Venturi principle are known to the art and are used to generate a sub-pressure, e.g., in a tank connected thereto. By vacuum is meant in this context the state of a gas whose particle density is less than the particle density of the atmosphere at the surface of the earth. The state of a gas can also be designated as a vacuum state when its pressure is lower than atmospheric pressure (DIN 28 400). Such ejectors can be used to generate a vacuum that can typically reach 10-kilopascal (−0.9 bar, 90% vacuum).

When such an ejector in a vacuum unit is coupled in a system that includes a tank and compressed-air conduits for the purpose of generating both pressure conditions and vacuum conditions a large quantity of auxiliary material is normally required for fitting and coupling together the system components. A conventional ejector cannot be used in such coupling systems without providing a relatively large number of additional devices, particularly in respect of a vacuum toilet system.

Swedish Patent Specification 502 345 C2 teaches a vacuum unit in which all desired functions have been integrated. The number of parts and ducts or conduits included in the unit, however, is relatively large, which results in undesirable production costs.

OBJECT OF THE INVENTION

Accordingly, one object of the present invention is to eliminate the aforesaid problems by providing a vacuum unit of the kind described in the introduction that includes fewer components and conduits than known vacuum units.

Another object of the present invention is to provide a vacuum toilet system that includes such a vacuum unit.

SUMMARY OF THE INVENTION

The present invention is based on the insight that the aforesaid objects can be achieved with a vacuum unit in which an ejector is used to generate both an overpressure and a sub-pressure, by respectively blocking and opening the outlet duct of the ejector.

Thus, an inventive vacuum unit includes a first valve which can be connected to a compressed air source and which has a closed first position and an open second position, a second valve which can be connected to a compressed air source, an ejector that includes an inlet nozzle, an outlet nozzle and a vacuum opening and that is connected to the first valve via said inlet nozzle and to a first connection of the vacuum unit via said vacuum opening, and a piston valve that includes a first inlet, a second inlet and an outlet and that has an open position in which the outlet connects with the first inlet, and a closed position in which the outlet is not connected to the first inlet and the second inlet, and in which piston valve the first inlet is connected to the ejector outlet nozzle, the second inlet is connected to the second valve, and the outlet is connected to a second connection of said vacuum unit, wherein said unit is characterised in that the second valve has a first position in which the second inlet of the piston valve connects with the surroundings, and a second position in which the second inlet of said piston valve communicates with the compressed air source, wherein the piston valve is adjusted to an open position with the second valve in its first position, whereby when the first valve is open there is generated a sub-pressure in the vacuum opening and the piston valve is adjusted to its closed position with the second valve in said second position, whereby opening of the first valve generates an overpressure in the vacuum opening.

This construction provides a vacuum unit that has fewer component parts and ducts or conduits than earlier units of this kind.

The invention also relates to a vacuum toilet system that includes such a vacuum unit.

Other preferred embodiments will be apparent from the dependent claims.

BRIEF DESCRIPTION OF THE DRAWINGS

The present invention will now be described in more detail by way of example, with reference to the accompanying drawings in which.

DESCRIPTION OF EMBODIMENTS

There will now be described a preferred embodiment of an inventive vacuum unit, and of a toilet system that includes such a vacuum unit.

Vacuum Unit

Figure 1:
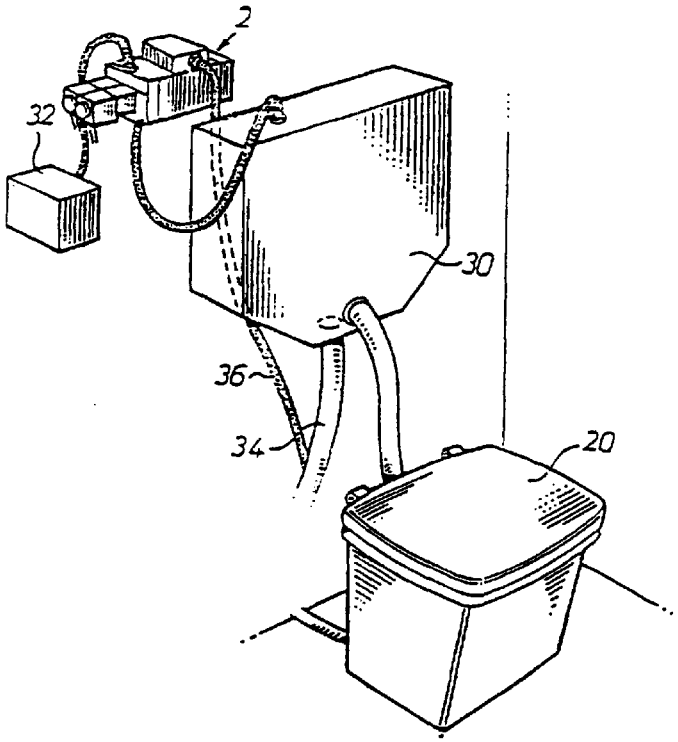
FIG. 1 is a perspective view of a vacuum toilet system that includes an inventive vacuum unit.
Figure 2:
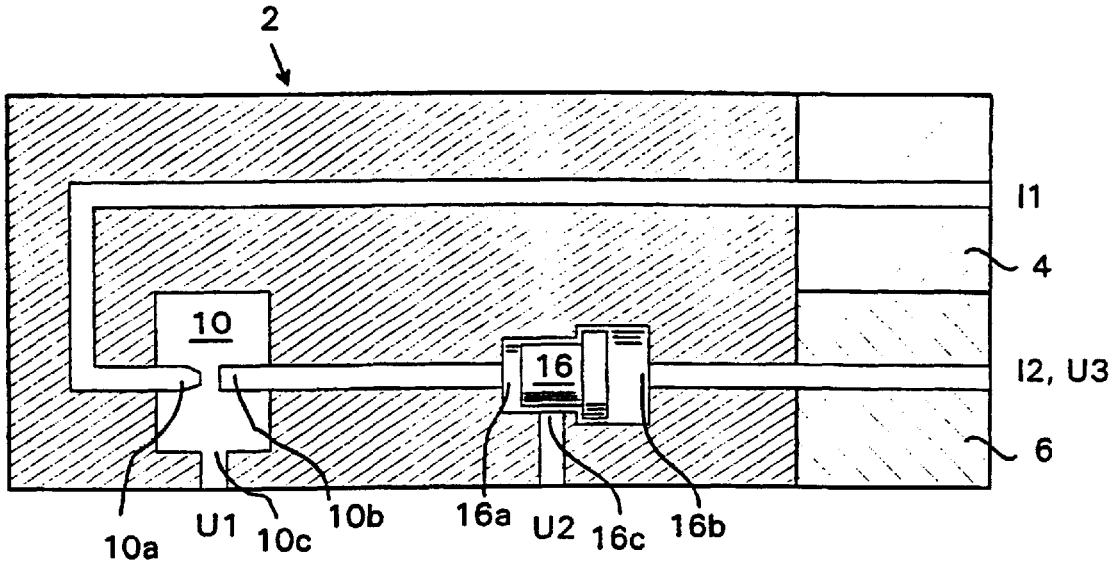
FIG. 2 is a sectional view of the vacuum unit shown in FIG. 1.
Figure 4:
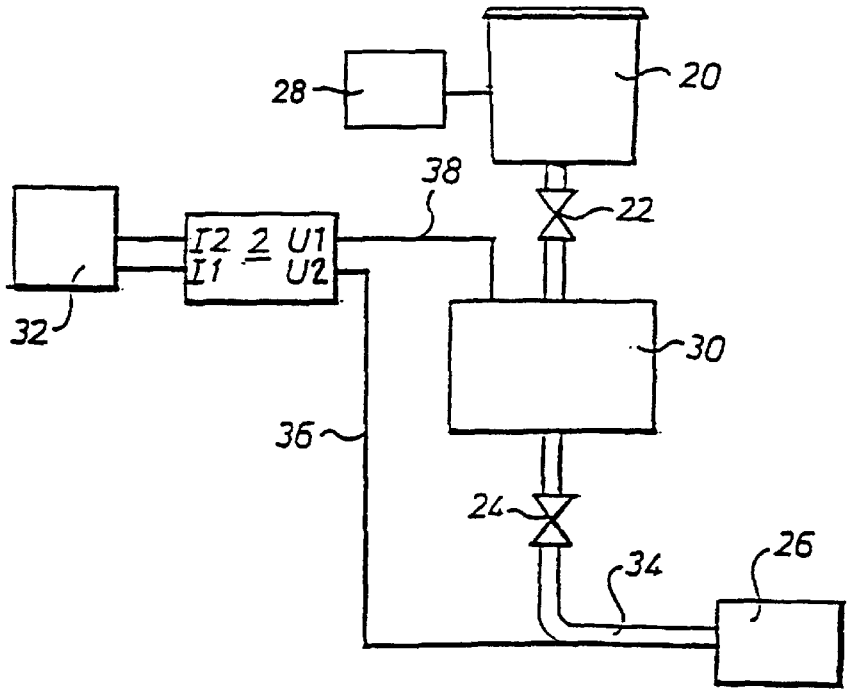
FIG. 4 is an elementary diagram of the toilet system shown in FIG. 1.

The vacuum unit 2, which is shown in FIG. 1 and illustrated in the outline diagram of FIG. 2, includes two solenoid valves 4 and 6 which can be connected to a compressed air source 32 via a respective inlet I1, I2; see FIGS. 1 and 4. The illustrated embodiment of the vacuum unit has two compressed air inlets, although the two solenoid valves 4, 6 could also be connected to a common compressed-air inlet on the vacuum unit.

Figure 3:
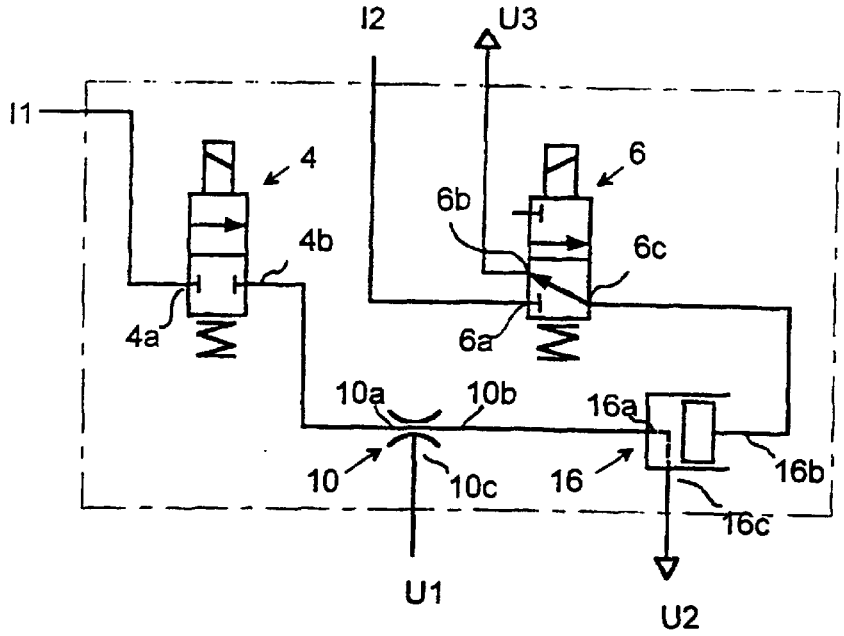
FIG. 3 is an elementary diagram of the vacuum unit in FIG. 1.

The modus operandi of the solenoid valves will now be explained with reference to FIG. 3. The first solenoid valve 4 is a so-called 2/2-valve that has a first non-activated position or mode in which its inlet 4*a* and its outlet 4*b* do not communicate with one another, in other words the valve is closed, and an activated second position or mode in which the inlet and the outlet of said valve communicate with one another, i.e. the valve is open. The first valve controls the supply of compressed air to the inlet nozzle 10*a* of an ejector 10.

The second solenoid valve 6 is a so-called 3/2-valve that has a non-activated first position or mode in which a first inlet 6*a* is not in communication with any outlet and an inlet/outlet 6*c* is in communication with outlet 6*b*, and an activated, second position in which inlet 6*a* communicates with inlet/outlet 6*c* and outlet 6*b* does not communicate with either inlet 6*a* or with inlet/outlet 6*c*. The inlet 6*a* can be connected to a compressed-air source 32 and the outlet 6*b* is in communication with the atmosphere surrounding the vacuum unit 2, i.e. with the ambient air, through the medium of a third outlet U3 on the vacuum unit. This outlet U3 can be connected to outlet U2 or to some other external connection so as to obtain a closed system. The inlet/outlet 6*c* is connected to a piston valve 16 that is maneuvered by the second solenoid valve 6, as described below.

As will be apparent from FIG. 2, when air flows from the inlet nozzle 10*a* to an outlet nozzle 10*b* a vacuum is generated in the interior of the ejector and in units that are in communication with this space via a vacuum opening 10c.

As also will be apparent from FIG. 2, the ejector inlet nozzle 10*a* is connected to the first solenoid valve 4 and the vacuum opening 10*c* is in communication with a first vacuum unit connection U1, which is preferably provided with a filter element.

The ejector outlet nozzle 10*b* is connected to a first inlet 16*a* of the piston valve 16. A piston valve outlet 16*c* is connected to a second vacuum unit connection U2. An air vent can be connected to the connection U2, such as to obtain a fully closed system.

The piston valve 16 is connected to the second solenoid valve 6 via a second inlet 16*b*. The surface area of the piston 16 facing the first inlet 16*a* is smaller than the surface area that faces the second inlet 16*b*. Consequently, the piston 16 strives to move from the second inlet 16*b* towards the first inlet 16*a* when the two inlets 16*a*, 16*b* are subjected to the same pressure, therewith closing the piston valve. In other words, the connection between the first inlet 16*a* and the outlet 16*c* is blocked.

The state of the piston valve, or its operational mode, is therefore regulated in the following manner. The state of the piston valve is undefined in the absence of pressure on the two inlets 16*a*, 16*b*. This lacks significance, since this would imply that the vacuum unit is not operational. When the second inlet 16*b* is subjected to pressure, the piston valve strives towards a closed state, even when the first inlet 16*a* is subjected to a corresponding pressure level. If the first solenoid valve 4 is then open, an overpressure will be generated in the ejector 10 because air delivered to the ejector inlet nozzle 10*a* is unable to flow out through the ejector outlet nozzle 10*b* as a result of the connection of the outlet nozzle 10*b* with the connection U2 being blocked by the piston valve 16. On the other hand, if the first solenoid valve is closed there occurs a holding state in which generated pressure in the ejector 10, and therewith in the first connection U1, is maintained essentially constant.

If finally the first solenoid valve 4 is open and the second solenoid valve 6 is in the position in which the second inlet 16*b* of the piston valve communicates with to the surroundings 43, the piston valve is forced to take an open position or state in which air is able to pass from the ejector inlet 10*a* to the ejector outlet 10*b*and from there through the piston valve 16 and the second connection U2. As a result, a sub-pressure or a vacuum is generated in the ejector, whereby a vacuum can be built-up in a container coupled to the first connection U1.

The aforesaid is elucidated by the following truth table:

| First solenoid valve 4 | Second solenoid valve 6 | Piston valve closed/open | Vacuum/ Overpressure |
|---|---|---|---|
| First position (closed) | First position (surroundings) | Undefined | Undefined |

-continued

| First solenoid valve 4 | Second solenoid valve 6 | Piston valve closed/open | Vacuum/ Overpressure |
|---|---|---|---|
| First position (closed) | Second position (compressed air source) | Closed | Holding position |
| Second position (compressed air source) | First position (surroundings) | Open | Vacuum |
| Second position (compressed air source) | Second position (compressed air source) | Closed | Overpressure |

A pressure sensor (not shown) is fitted to a hose 38 mounted on the connection U1. A signal is sent from the sensor to a control unit (not shown) when a vacuum is desired in a tank connected with the vacuum unit via said connection U1.

Finally, a safety valve (not shown) is connected either to the hose 38 or to the tank 30.

The inventive unit 2 is preferably injection moulded from acetal resin (POM).

System

FIG. 4 illustrates by way of example a vacuum toilet system that includes a toilet 20, which may be of a conventional kind. The toilet 20 is connected via an inlet valve 22 with a pressure-safe tank 30 for the intermediate storage of material leaving the toilet 20. In the preferred illustrated embodiment, the tank accommodates about two litres although it is not filled with more than about 2 dl of flushing water in normal operation.

The system also includes a collecting vessel 26 which is connected to the tank 30 via an outlet valve 24 and an outlet pipe 34. The valves 22, 24 are maneuvered by valve setting devices controlled by the control unit. A water container 28 is connected to the toilet 20.

Finally, the system includes an inventive vacuum unit 2 which is driven by a compressed-air source 32. The source 32 preferably operates at a pressure in the region of 4–8 bar. The first connection U1 of the vacuum unit is connected to the pressure tank 30 via a hose 38, the second connection U2 is connected to the outlet pipe 34 via a ventilating pipe 36, and the third connection U3 is connected to the ambient atmosphere.

Modus Operandi

The modus operandi of the inventive vacuum unit will now be described with reference to a typical working cycle of a unit used in the vacuum toilet system illustrated here by way of example only.

There is initially no vacuum in the tank 30. The two solenoid valves are in their first positions, i.e. the compressed-air source 32 is disconnected. The first solenoid valve 4 is activated, for instance by means of an electric pulse, e.g. a 24V D.C. pulse, delivered from an electric power source (not shown). It is ensured at the same time that the second solenoid valve 6 is in its first position, i.e. with the second inlet 16*b* of the piston valve connected to the surroundings. Compressed air is therewith allowed to pass from the compressed-air source 32 through the first valve and to flow transversely through the ejector 10, from the smaller inlet nozzle 10*a* to the larger outlet nozzle 10*b* and further through the ventilating pipe 36 and the outlet pipe 34, where it has a cleaning function. A vacuum is generated in the ejector 10, and therewith also in the tank 30, at the same time.

The valves 22 and 24 are closed at this stage.

The pressure sensor sends a signal when the desired vacuum has been reached in the tank 30. At this stage, the first solenoid valve 4 closes and activates the second solenoid valve 6 practically at the same time, so as to cause the second solenoid valve to take its second position or mode. The vacuum unit 2 therewith enters its holding mode. The toilet can now be flushed.

The vacuum toilet may be prepared in this way while awaiting a flushing signal, or the build-up of a vacuum may be commenced in response to a flushing signal. The flushing signal can be generated with the aid of a press button or in some other way, for instance by means of a switch connected to the toilet lid. When the flushing signal has been received and a vacuum has been generated in the tank 30, the inlet valve 22 is opened therewith allowing the vacuum existing in the tank 30 to draw the contents of the toilet into the tank by suction, together with water from the water container 28, which in this stage of the process has already been pressurised via means (not shown), said water flushing clean the walls of the toilet.

The inlet valve 22 closes when the contents of the toilet have been sucked into the tank 30. The first solenoid valve 4 is then activated so as to cause an overpressure to be generated as a result of the compressed air flowing through the ejector 10 and into the tank 30 through the hose 38. The ejector 10 and the hose 38 are also cleansed of undesirable particles in this way. When pressure has been built-up in the tank 30, the first solenoid valve 4 is closed so that the vacuum unit will return to its holding mode. The outlet valve 24 is then opened, thereby emptying the contents of the tank 30 into the collecting vessel 26.

Finally, the outlet valve 24 is closed, preferably in a time-controlled fashion, while deactivating the two solenoid valves at the same time, i.e. causing said valves to return to their respective first positions. The procedure can then be repeated.

Because, in accordance with the invention, the system operates with full pressure on the piston valve 16 there is obtained a particularly reliable construction, since the risk of the piston becoming blocked by dirt particles and the like is thereby minimised. Furthermore, the absence of a check valve renders the construction both cheaper and more reliable than known vacuum units.

Although a preferred embodiment of an inventive vacuum unit has been described, it will be understood that said embodiment can be altered in several respects within the scope of the accompanying claims. For instance, although the ejector of the preferred embodiment has only one inlet nozzle and only one outlet nozzle, it will be understood that the ejector may include several inlet and outlet nozzles. This would enable a greater pressure generating capacity to be achieved, therewith shortening the cycle times.

Although the valves 4 and 6 of the vacuum unit 2 have been described as solenoid valves, it will be understood by the person skilled in this field that any suitable valve may be used. It will also be understood that the pressure sensor and the safety valve may be integrated with the vacuum unit.

What is claimed is:

1. A vacuum unit that comprises a first valve (4) that can be connected to a compressed-air source (32) and that has a first, closed position and a second, open position;

a second valve (6) that can be connected to a compressed-air source (32);

an ejector (10) that includes an inlet nozzle **(10*a*), an outlet nozzle (10*b*), and a vacuum opening (10*c*), wherein the ejector is connected to the first valve (4) via the inlet nozzle, and to a first connection (U1) of said vacuum (2) via said vacuum opening; and a piston valve (16) that has a first inlet (16*a*), a second inlet (16*b*) and an outlet (16*c*), wherein said piston valve has an open position in which the outlet (16*c*) connects with the first inlet (16*a*), and a closed position in which the outlet (16*c*) is not connected to the first inlet (16*a*) or the second inlet (16*b*), and with which piston valve (16) the first inlet is connected to the outlet nozzle (10*b*) of the ejector, the second inlet is connected to the second valve (6), and the outlet is connected to a second connection (U2) of said vacuum unit, said vacuum unit being characterised in that the second valve (6) has a first position in which the second inlet (16*b*) of the piston valve (16) connects with the surroundings, and a second position in which the second inlet (16*b*) of the piston valve (16) connects with the compressed-air source; wherein the piston valve (16) is adjusted to an open position with the second valve (16) in its first position, whereby an open position of the first valve (4) causes a sub-pressure to be generated in the vacuum opening; and wherein the piston valve (16) is adjusted to a closed position with the second valve (6) in its second position, whereby opening of the first valve (4)** causes an overpressure to be generated in the vacuum opening.

2. A vacuum unit according to claim 1, characterised in that at least one of said first and second valves (4, 6) is a solenoid valve.

3. A vacuum unit according to claim 1, characterised in that the second valve (6) is a 3/2-valve.

4. A vacuum unit according to claim 1, characterised in that the valves can be connected to mutually the same compressed-air source through the medium of a common inlet.

5. A vacuum unit according to claim 1, characterised by a pressure sensor connected to the first vacuum unit connection (U1).

6. A vacuum unit according to claim 1, characterised by a safety valve connected to the first connection (U1) of said vacuum unit (2).

7. A vacuum unit according to claim 1, characterised in that said unit has been manufactured by an injection moulding process.

8. A vacuum unit according to claim 7, characterised in that said unit is made of acetal resin.

9. A vacuum toilet system that includes a toilet (20), a water container (28) connected to said toilet, an intermediate storage tank (30) connected to said toilet via an inlet valve (22), a storage tank (26) connected to the intermediate storage tank via an outlet valve (24), and a compressed-air source (32), characterised by a vacuum unit (2) according to claim 1 connected to the compressed-air source via said first and second valves (4, 6), and connected to said intermediate storage tank via said first connection (U1) and to said storage tank via said second connection (U2).

* * * * *